US006916980B2

(12) United States Patent
Ishida et al.

(10) Patent No.: US 6,916,980 B2
(45) Date of Patent: Jul. 12, 2005

(54) ACOUSTIC CONTROL SYSTEM FOR ELECTRONIC MUSICAL INSTRUMENT

(75) Inventors: Tadayuki Ishida, Shizuoka-ken (JP); Katsuhiko Torii, Shizuoka-ken (JP)

(73) Assignee: Kabushiki Kaisha Kawai Gakki Seisakusho, Hamamatsu (JP)

( * ) Notice: Subject to any disclaimer, the term of this patent is extended or adjusted under 35 U.S.C. 154(b) by 258 days.

(21) Appl. No.: 10/420,899

(22) Filed: Apr. 23, 2003

(65) Prior Publication Data

US 2003/0196541 A1 Oct. 23, 2003

(30) Foreign Application Priority Data

Apr. 23, 2002 (JP) ..... 2002-120318

(51) Int. Cl.[7] ..... G10H 1/32

(52) U.S. Cl. ..... 84/743; 84/601; 84/DIG. 1; 381/118

(58) Field of Search ..... 84/743, 601, DIG. 1; 381/118, 17, 87, 334, 335, 386, 111, 59, 116, 119, 61, 306, 337, 794, 74, 309; 181/199, 148, 160

(56) References Cited

U.S. PATENT DOCUMENTS 3,612,741 A * 10/1971 Marshall ..... 84/723
4,058,045 A * 11/1977 Jennings et al. ..... 84/731
4,203,340 A * 5/1980 Ostrom ..... 84/672
4,329,902 A * 5/1982 Love ..... 84/706
6,399,870 B1 * 6/2002 Azima et al. ..... 84/744
6,605,765 B1 * 8/2003 Johnson ..... 84/267
6,696,632 B2 * 2/2004 Minakuchi et al. ..... 84/735

* cited by examiner

*Primary Examiner*—Marlon T. Fletcher
*Assistant Examiner*—David S. Warren
(74) *Attorney, Agent, or Firm*—Crowell & Moring LLP

(57) ABSTRACT

An acoustic control system for an electronic musical instrument, which can obtain optimal acoustic characteristics irrespective of whether or not a low range speaker is attached to a body thereof. A piano body has high range and mid range speakers. A low range speaker is removable from the body. A stand-excluding switch designates a first speaker-use mode for using the high range and mid range speakers alone, and a stand-including switch designates a both speaker-use mode for using both the high range and mid range speakers and the low range speaker. A ROM stores stand-excluding and stand-including factors for setting acoustic characteristics in the two modes, respectively. A CPU reads one of the factors, which corresponds to the mode designated by the stand-excluding or stand-including switch. A tone generator circuit generates a musical tone signal to be reproduced in one of the modes, based on the read factor.

6 Claims, 9 Drawing Sheets

ACOUSTIC CONTROL SYSTEM FOR ELECTRONIC MUSICAL INSTRUMENT

BACKGROUND OF THE INVENTION

1. Field of the Invention

This invention relates to an acoustic control system for an electronic musical instrument, for controlling acoustic characteristics of the electronic musical instrument having a musical instrument body and a speaker removable from the musical instrument body.

2. Description of the Prior Art

In general, a conventional electronic musical instrument (e.g. an electronic piano) has a musical instrument body (piano body) and a stand integrally formed with the musical instrument body. As for speakers of an electronic piano constructed as above, there are two types of arrangement thereof, i.e. one in which speakers are mounted in a piano body alone and the other in which different types of speakers for different frequency ranges are mounted in a piano body and a stand, respectively. In the latter type, the speaker system as a whole is acoustically designed such that optimal acoustic characteristics can be obtained assuming that the both types of speakers are used simultaneously. Recently, another electronic piano of a portable type has been proposed which is comprised of a piano body compact in size with integrated speakers and a stand removable from the piano body. This portable electronic piano is advantageous in that the piano body is portable without necessitating much space, and further, since the piano body has the integrated speakers, it is possible to play anywhere with the piano body alone.

However, in the above conventional portable electronic piano, the piano body has a casing with a limited internal space, and hence it is impossible to increase either the diameter of each speaker or the number of the speakers. Therefore, sound from the electronic piano is rather powerless particularly in the low-frequency range, which makes it difficult to obtain excellent acoustic characteristics. A possible solution to this problem, for instance, is to employ the speaker system used in the above-described electronic piano of the latter of the stand-integrated types and arrange a speaker for the low-frequency range in the removable stand for increased output of low-frequency components. In this case, however, the speaker system including the two types of speakers is acoustically designed such that optimal acoustic characteristics can be obtained by the system as a whole. Therefore, when the piano body alone is carried somewhere and played, low-frequency components which should be output from the speaker in the stand are lost, and only mid-frequency and high-frequency components are output from the speakers in the piano body, so that the acoustic balance is lost, which makes it impossible to obtain excellent acoustic characteristics.

SUMMARY OF THE INVENTION

It is an object of the invention to provide an acoustic control system for an electronic musical instrument having a second speaker removable from a musical instrument body having a first speaker, which is capable of obtaining optimal acoustic characteristics irrespective of whether or not the second speaker is attached to the musical instrument body.

To attain the above object, the present invention provides an acoustic control system for an electronic musical instrument, comprising:

a musical instrument body having a first speaker;

a second speaker removable from the musical instrument body;

designation means for designating one of a first speaker-use mode for using the first speaker alone and a both speaker-use mode for using both the first speaker and the second speaker, as a speaker use mode;

storage means for storing first and second acoustic-characterizing factors different from each other, for use in setting acoustic characteristics in the first speaker-use mode and the both speaker-use mode, respectively;

reading means for reading one of the first and second acoustic-characterizing factors, the one corresponding to the speaker use mode designated by the designation means; and musical tone signal-generating means for generating a musical tone signal to be reproduced through the first speaker or both the first speaker and the second speaker, based on the read one of the first and second acoustic-characterizing factors.

In this electronic musical instrument, the musical instrument body has the first speaker, and the second speaker is provided in a manner removable from the musical instrument body. Further, according to the acoustic control system, the first acoustic-characterizing factor for the first speaker-use mode in which the first speaker alone is used and the second acoustic-characterizing factor for the both speaker-use mode in which the first speaker and the second speaker are simultaneously used are individually preset and stored as two different factors, and when one of the first speaker-use mode and the both speaker-use mode is designated by the designation means, one of the acoustic-characterizing factors which corresponds to the designated speaker use mode is read out, and a musical tone signal to be reproduced through one or two of the speakers selected for use is generated based on the read acoustic-characterizing factor.

As described above, when the first speaker-use mode is designated, a musical tone signal to be reproduced through the first speaker is generated based on the first acoustic-characterizing factor, while when the both speaker-use mode is designated, a musical tone signal to be reproduced through the first and second speakers is generated based on the second acoustic-characterizing factor. Therefore, by setting the first and second acoustic-characterizing factors in advance such that optimal acoustic characteristics can be obtained in the first speaker-use mode and the both speaker-use mode, respectively, it is possible to obtain the optimal acoustic characteristics irrespective of whether or not the second speaker is attached to the musical instrument body.

Preferably, the designation means comprises a switch for operation by a player for designation of the speaker use mode.

According to this preferred embodiment, a player can freely select desired acoustic characteristics based on the first or second acoustic-characterizing factor by operating the switch. In this case, by setting the switch to a normal setting such that the both speaker-use mode is designated when the second speaker is attached to the musical instrument body or the first speaker-use mode is designated when the second speaker is not attached to the musical instrument body, it is possible to obtain optimal acoustic characteristics. Further, it is also possible to set the switch to a reverse setting. This makes it possible to obtain acoustic characteristics according to the preference of the player, an environment of a playing site, and so forth.

Preferably, the designation means includes detection means for detecting whether or not the second speaker is attached to the musical instrument body, and setting means for setting the speaker use mode to the first speaker-use mode when it is detected by the detection means that the second speaker is not attached to the musical instrument body, and setting the speaker use mode to the both speaker-use mode when it is detected by the detection means that the second speaker is attached to the musical instrument body.

According to this preferred embodiment, it is detected whether or not the second speaker is attached to the musical instrument body, and then, the speaker use mode is set to the first speaker-use mode when the second speaker is not attached to the musical instrument body, or set to the both speaker-use mode when the second speaker is attached to the musical instrument body. Therefore, it is possible automatically set the speaker use mode properly without necessitating any operation by a player, thereby readily obtaining optimal acoustic characteristics depending on whether the second speaker is attached or not.

Preferably, the second speaker is a speaker for reproducing tones in a low-frequency range.

According to this preferred embodiment, levels of low-frequency components of sound which could become insufficient if the first speaker alone were used can be effectively increased by the use of the second speaker. As a result, in the both speaker-use mode, it is possible to obtain optimal acoustic characteristics with sufficiently high levels of low-frequency components.

Preferably, the acoustic control system further includes tone volume-setting means for setting a tone volume of the second speaker independently of a tone volume of the first speaker.

According to this preferred embodiment, in the both speaker-use mode, it is possible to hold the tone volume of the entire speaker system in an optimal balance for the acoustic characteristics in the current performance environment, and further adjust only the tone volume of the second speaker by the tone volume-setting means, thereby obtaining a tone volume balance according to the preference of a player, an environment of a playing site, and so forth.

Preferably, the second speaker is arranged in a stand that is removably attached to the musical instrument body, for supporting the musical instrument body.

According to this preferred embodiment, since the stand is removable from the musical instrument body, the electronic musical instrument is constructed as a portable type which allows the musical instrument body alone to be transported. Further, the stand has more space available than the musical instrument body, and hence it is possible to easily configure the layout of the speakers through effective utilization of this space. For instance, it is possible to easily dispose a large-sized speaker as the second speaker.

The above and other objects, features, and advantages of the invention will become more apparent from the following detailed description taken in conjunction with the accompanying drawings.

DETAILED DESCRIPTION OF PREFERRED EMBODIMENTS

The invention will now be described in detail with reference to the drawings showing preferred embodiments thereof.

Figure 1:
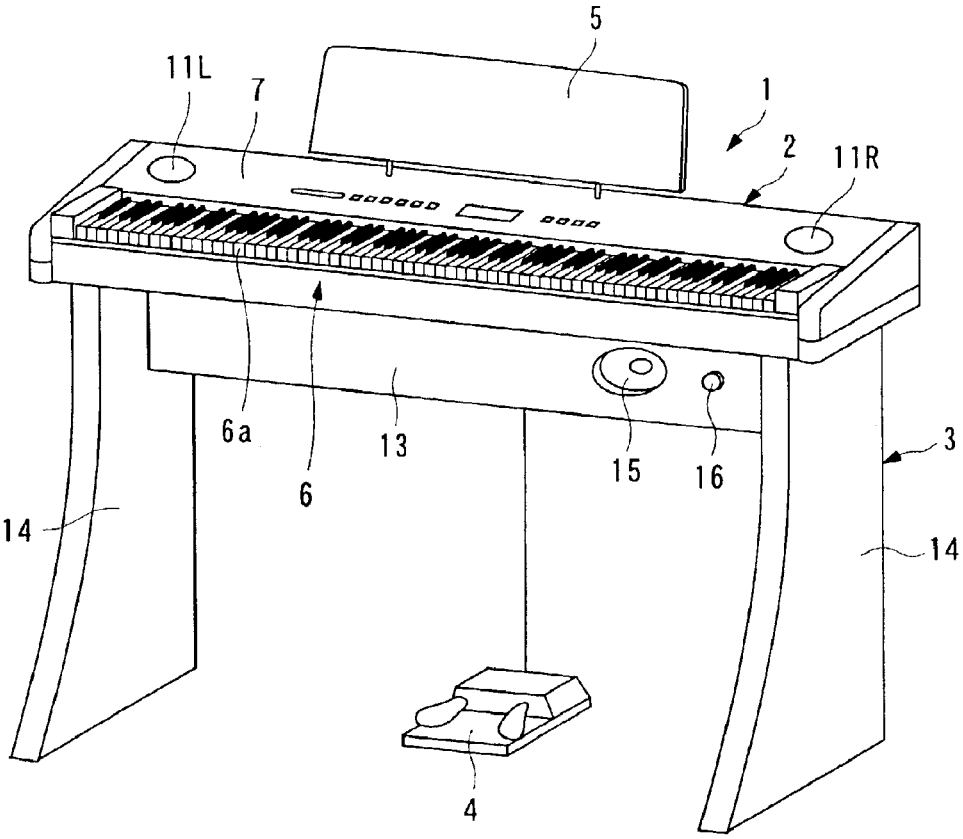
FIG. 1 is a perspective view of an electronic piano incorporating an acoustic control system according to the invention.

Referring first to FIG. 1, there is shown an electronic piano incorporating an acoustic control system according to the invention. This electronic piano 1 has a piano body 2 (musical instrument body) and a stand 3 supporting the piano body 2, and further includes a pedal 4 and a music stand 5. The stand 3 is removably attached to the piano body 2 by left and right screws, not shown. That is, the electronic piano 1 is a portable type which can be carried without the stand 3 by removing the same from the piano body 2.

Figure 2:
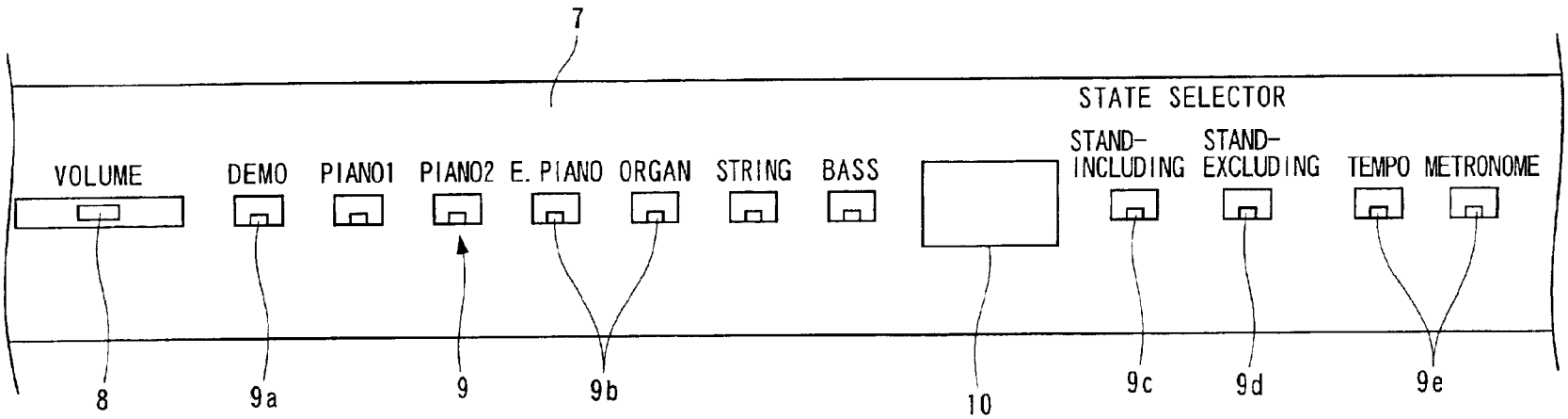
FIG. 2 is a partial plan view of an operation panel of the FIG. 1 electronic piano.

On the top of the front portion of the piano body 2, there is arranged a keyboard 6 in a manner extending in a left-right direction, as viewed in the figure, while on the top of the rear portion of the same, there is arranged an operation panel 7. The keyboard 6 is comprised of numerous keys 6*a* and key switches, not shown, each of which is opened/closed (turned on/off) by key-on operation/key-off operation of the corresponding one of the keys 6*a*. As shown in FIG. 2, on the operational panel 7, there are arranged a power switch, not shown, a master volume 8, various switches 9, a display 10, and so forth. The master volume 8 is used for setting the entire tone volume of the electronic piano 1. The switches 9 include a demonstration performance switch 9*a*, lots of tone color selection switches 9*b*, a stand-including switch 9*c* and a stand-excluding switch 9*d* each used as designation means for designating a speaker use mode, described hereinafter, and a tempo switch 9*e*, all of which are arranged in the mentioned order from the left. The display 10 is formed e.g. of liquid crystal, and displays settings of the master volume 8 and the switches 9, etc.

A pair of small-sized speaker units (hereinafter referred to as "the high range speakers") 11L, 11R for reproducing tones in the high-frequency range are arranged at the respective left-side and right-side ends of the operation panel 7, and a pair of small-sized speaker units (hereinafter referred to as "the mid range speakers") 12L, 12R for reproducing tones in the mid-frequency range are arranged at the respective left-side and right-side ends of the rear of the piano body 2. In the present embodiment, the high range and mid range speakers 11L, 11R, 12L, 12R form a first speaker of the piano body 2.

Figure 4:
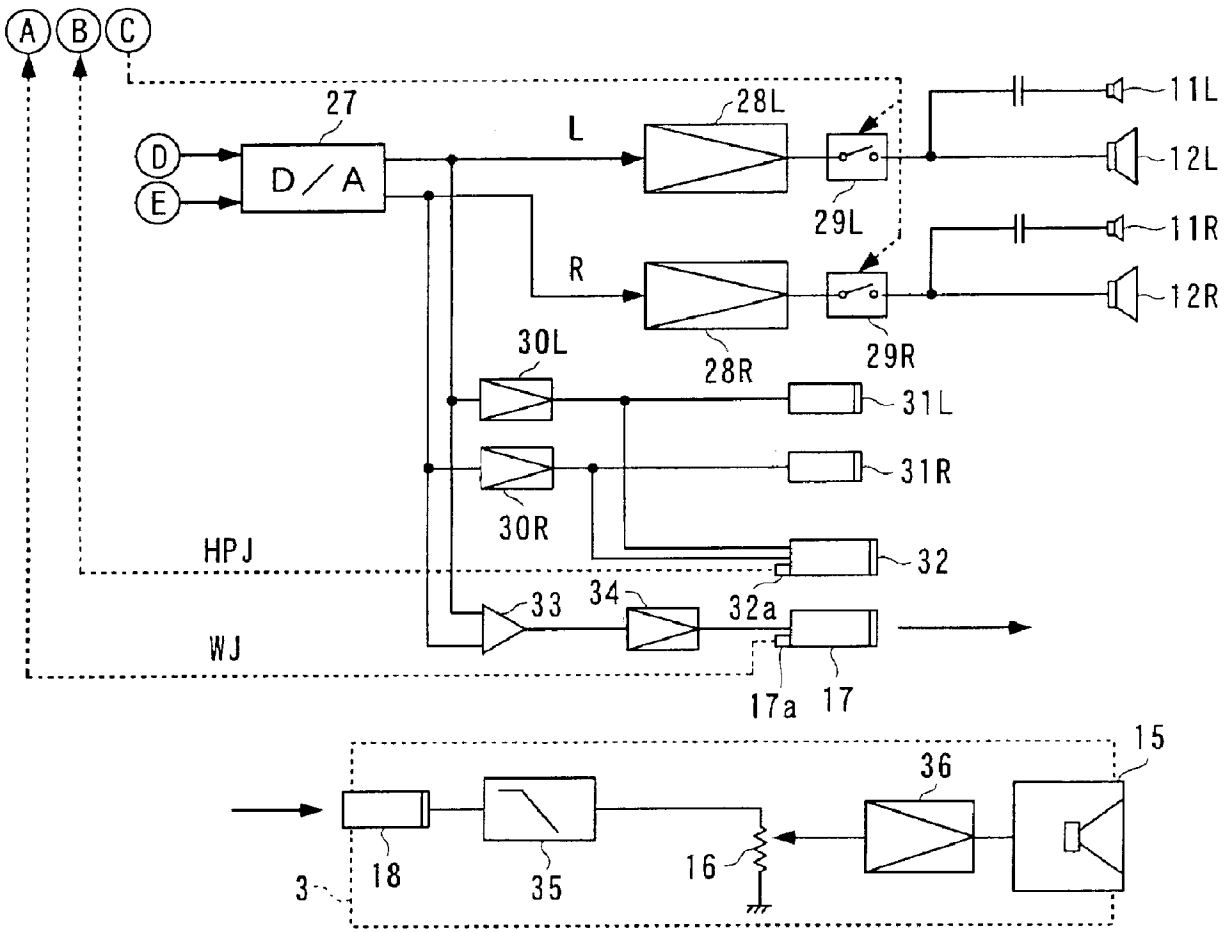
FIG. 4 shows the remaining part of the FIG. 3 circuitry.

On the other hand, the stand 3 is a unitary assembly formed by combining a back board 13 extending in the left-right direction and left and right leg plates 14, 14 extending downward. A speaker unit (woofer, hereinafter referred to as "the low range speaker") 15 for reproducing tones in the low-frequency range is arranged in the front of the back plate 13, as a second speaker. The low range speaker 15 has a larger diameter than that of the mid range speakers 12L, 12R. Further, in the vicinity of the low range speaker 15, there is arranged a woofer volume 16 for setting only the tone volume of the low range speaker 15 independently from the master volume 8. It should be noted that connection between the low range speaker 15 and the piano body 2 is established by connecting woofer jacks 17, 18 (see FIG. 4) arranged on the respective rear surfaces of the piano body 2 and the stand 3 by a connector cable, not shown.

Figure 3:
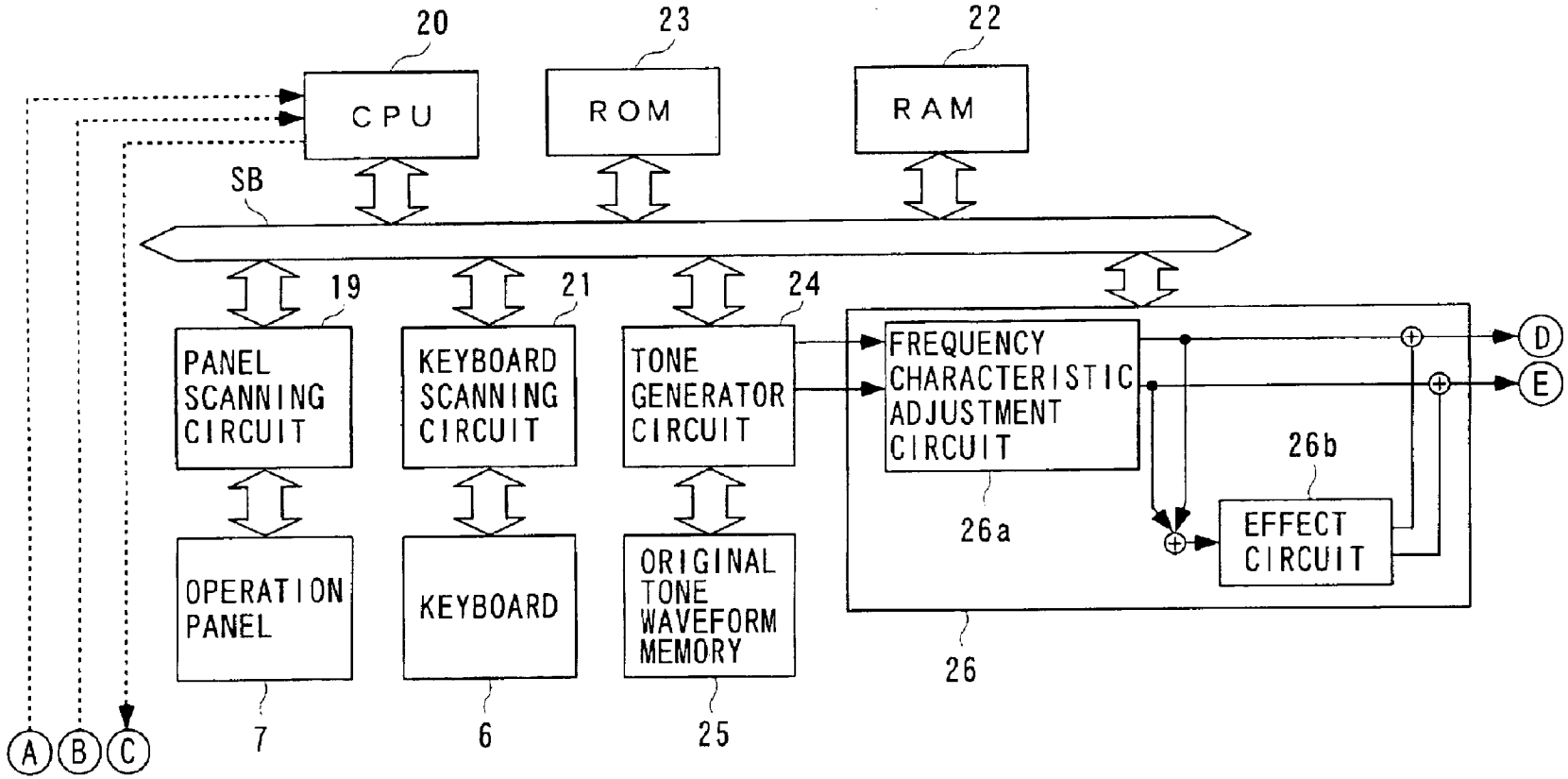
FIG. 3 is a circuit diagram showing circuitry for controlling tone generation of the FIG. 1 electronic piano.

FIG. 3 shows circuitry for controlling tone generation by the electronic piano 1. First, the settings of the power switch and the switches 9 on the operation panel 7 are detected by a panel scanning circuit 19 and delivered as panel switch data to a CPU 20 via a system bus SB. Further, the ON/OFF states of the key switches of the keyboard 6 are detected by a keyboard scanning circuit 21, and ON/OFF information of each key switch, note numbers, and touch data indicative of velocities are delivered as key-on information data from the keyboard scanning circuit 21 to the CPU 20 via the system bus SB. The woofer jack 17 of the piano body 2 incorporates a woofer switch 17*a* (detection means) for detecting whether or not the jack of the connector cable is plugged into the woofer jack 17, and a detection signal WJ indicative of the state of the woofer jack 17 generated by the woofer switch 17*a* is delivered to the CPU 20. Similarly, from a headphone switch 32*a* incorporated in a headphone jack 32 referred to hereinafter, a detection signal HPJ indicative of whether or not the jack of headphones, not shown, is plugged in is delivered to the CPU 20 (see FIG. 4).

A RAM 22 temporarily stores status information indicative of the operating state of the electronic piano 1 and other data. The RAM 22 is also used as a work area for the CPU 20. A ROM 23 stores control programs executed by the CPU 20, and fixed data including frequency characteristic curves, described hereinafter, which are used for arithmetic operations carried out by the CPU 20. The RAM 22 and the ROM 23 are accessed by the CPU 20 via the system bus SB.

The CPU 20 which controls the overall operation of the electronic piano 1 calculates the frequency characteristic and output level of each musical tone to be generated, according to the control programs, based on the panel switch data from the panel scanning circuit 19, the key-on information data from the keyboard scanning circuit 21, the detection signal WJ from the woofer switch 17*a*, and so forth, and delivers to a tone generator circuit 24 and a DSP (digital signal processor) 26 a control signal generated based on the results of the calculation.

The tone generator circuit 24 reads original tone waveform data from an original tone waveform memory 25 in response to the control signal output from the CPU 20, and multiplies the data by an envelope to generate digital musical tone signals for two channels, followed by delivering the digital musical tone signals to the DSP 26. The DSP 26 includes (i.e. implements) a frequency characteristic adjustment circuit 26*a* and an effect circuit 26*b*. The frequency characteristic adjustment circuit 26*a* adjusts the frequency characteristic of each musical tone signal based on a frequency characteristic determined by the CPU 20 as described hereinafter. The effect circuit 26*b* imparts acoustic effects, such as reverberation and chorus, to musical tone signals in response to the control signal from the CPU 20.

After being output from the DSP 26, the musical tone signals for the respective left and right channels are converted to analog signals by a D/A converter 27, and then delivered to respective main amplifiers 28L, 28R and respective headphone amplifiers 30L, 30R, as well as to a mixing amplifier 33 for the low range speaker 15.

The audio signals amplified by the main amplifiers 28L, 28R are delivered to the high range speakers 11L, 11R and the mid range speakers 12L, 12R via relays 29L, 29R, for reproduction of sound. On the other hand, the audio signals amplified by the headphone amplifiers 30L, 30R are delivered to line-out jacks 31L, 31R and the headphone jack 32.

Further, the audio signals mixed by the mixing amplifier 33 are amplified by the preamplifier 34 and then delivered to the woofer jack 17. When the woofer jack 18 of the stand 3 is connected to the woofer jack 17, the mixed audio signals are further delivered to a power amplifier 36 via the woofer jack 18 and a low-pass filter 35 to be amplified according to a tone volume set by the woofer volume 16. Thereafter, the amplified mixed audio signals are delivered to the low range speaker 15, for reproduction of sound.

Figure 5:
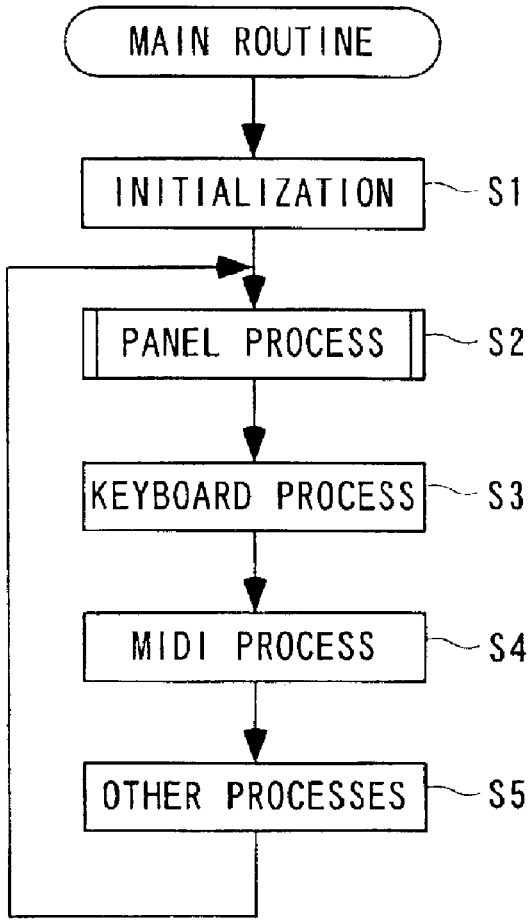
FIG. 5 is a flowchart of a main routine of a control process executed by a CPU appearing in FIG. 3.

FIG. 5 shows a main routine of a control process executed by the CPU 20. In this process, when the power switch is turned on, initialization is performed in a step S1, including initialization of data stored in the RAM 22. Then, a panel process is executed in a step S2, based on panel switch data from the panel scanning circuit 19. The panel process will be described in detail hereinafter. In a step S3, a keyboard process is executed based on key-on data information from the keyboard scanning circuit 21. Subsequently, MIDI data is transmitted/received in a step S4, and then other processes are executed in a step S5. The above-mentioned steps S2 to S5 are repeatedly carried out until the power switch is turned off.

Figure 6:
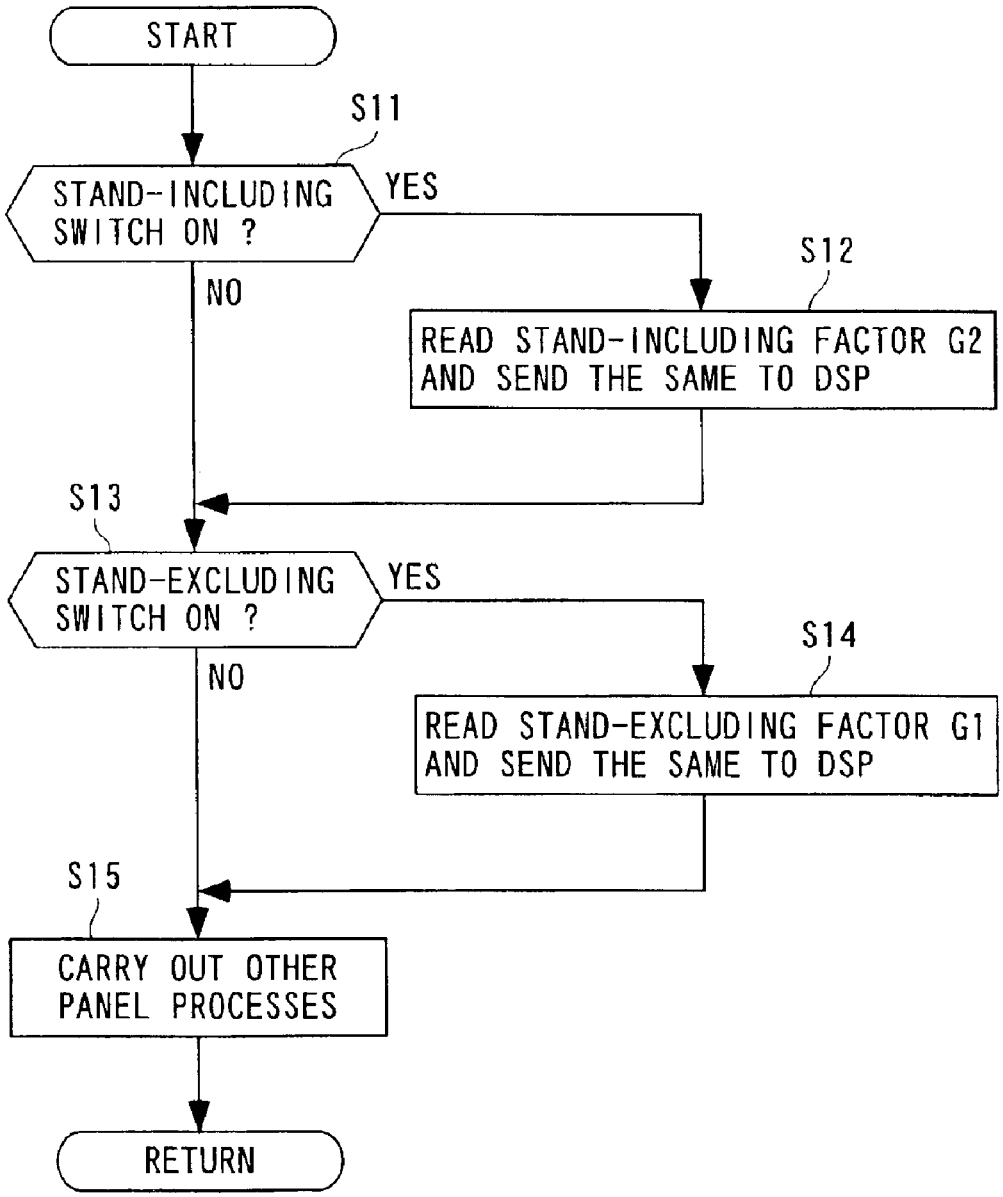
FIG. 6 is a flowchart of a subroutine of a panel process executed in FIG. 5.

FIG. 6 shows a subroutine of the panel process executed in the step S2 in FIG. 2. In this process, first, it is determined in a step S11 whether or not the stand-including switch 9*c* is turned on. If the answer to the question is affirmative (YES), i.e. if a player has designated a mode (both speaker-use mode) for simultaneously using not only the high range and mid range speakers 11L, 11R, 12L, 12R of the piano body 2 but also the low range speaker 15 of the stand 3, a stand-including factor G2 (second acoustic-characterizing factor) for the both speaker-use mode is read from the frequency characteristic curves stored in the ROM 23 and delivered to the frequency characteristic adjustment circuit 26*a* of the DSP 26 in a step S12. The frequency characteristic adjustment circuit 26*a* adjusts the frequency characteristic of each musical tone signal based on the stand-including factor G2.

Figure 7:
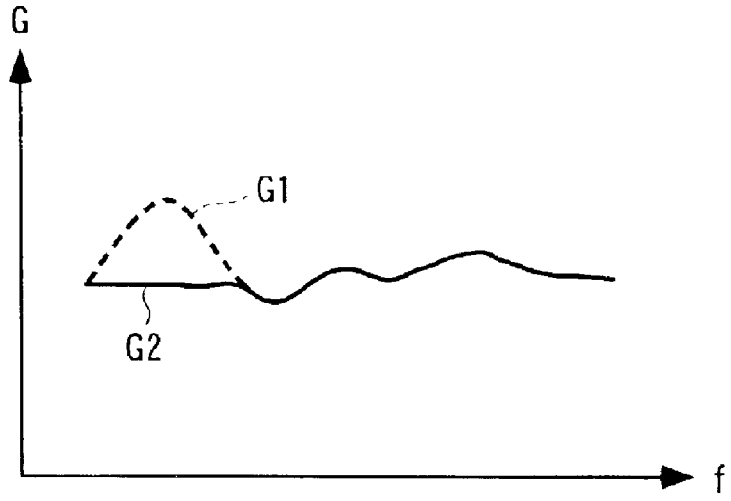
FIG. 7 is a diagram showing frequency characteristic curves.

As shown in FIG. 7, the frequency characteristic curves each determine a gain with respect to a frequency f, as a factor G. The stand-including factor G2 indicated by a solid line in this figure is set such that optimal acoustic characteristics can be obtained by an entire speaker system composed of the high range and mid range speakers 11L, 11R, 12L, 12R and the low range speaker 15. For instance, in the both speaker-use mode, the use of the low range speaker 15 makes it possible to readily reproduce sufficiently high levels of low-frequency components, and hence in the illustrated example, the stand-including factor G2 is set to be relatively flat in the low-frequency range.

Referring again to FIG. 6, if the answer to the question of the step S11 is negative (NO), or after the step S12 is executed, it is determined in a step S13 whether or not the stand-excluding switch 9*d* is turned on. If the answer to the question is affirmative (YES), i.e. if the player designates a mode (first speaker-use mode) for using only the high range and mid range speakers 11L, 11R, 12L, 12R of the piano body 2 without using the low range speaker 15, a stand-excluding factor G1 (first acoustic-characterizing factor) for the first speaker-use mode, which is indicated by the broken line in FIG. 7, is read from the frequency characteristic curves and delivered to the frequency characteristic adjustment circuit 26*a* of the DSP 26 in a step S14.

The stand-excluding factor G1 is set such that optimal acoustic characteristics can be obtained by the speaker system of the piano body 2 alone, excluding the low range speaker 15 of the stand 3. For instance, in the first speaker-use mode, since the low range speaker 15 is not used, it is difficult to reproduce sufficiently high levels of low-frequency components, and hence in the FIG. 7 example, the stand-excluding factor G1 is set to be higher in the low-frequency range than the stand-including factor G2.

Referring again to FIG. 6, if the answer to the question of the step S13 is negative (NO), or after the step S14 is executed, other panel processes are performed in a step S15. Thereafter, the program returns to the step S11, and the above steps are repeatedly carried out.

As described above, according to the present embodiment, when the stand-including switch 9*c* is turned on to designate the both speaker-use mode, the frequency characteristics of musical tone signals to be reproduced through the high range and mid range speakers 11L, 11R, 12L, 12R and the low range speaker 15 are adjusted based on the stand-including factor G2 configured as above. On the other hand, when the stand-excluding switch 9*d* is turned on to designate the first speaker-use mode, the frequency characteristics of musical tone signals to be reproduced through the high range and mid range speakers 11L, 11R, 12L, 12R are adjusted based on the stand-excluding factor G1 configured differently from the stand-including factor G2. Therefore, irrespective of whether or not the stand 3 is attached to the piano body 2, it is possible to obtain optimal acoustic characteristics.

Further, by selectively turning on the stand-including switch 9*c* and the stand-excluding switch 9*d* depending on whether or not the stand 3, or more specifically the low range speaker 15, is present, i.e. integrated in the speaker system, the player can obtain optimal acoustic characteristics in both of the speaker use modes. Alternatively, it is possible to set the switches 9*c*, 9*d* to reverse settings. This makes it possible to obtain acoustic characteristics according to the preference of the player, an environment of a playing site, and so forth.

Furthermore, since the large-diameter low range speaker 15 is arranged in the stand 3 having more space available than the piano body 2, it is possible to obtain optimal acoustic characteristics with sufficiently high levels of low-frequency components, by effective utilization of the space on the stand 3. Moreover, in addition to the master volume 8 for setting the tone volume of the entire speaker system, the woofer volume 16 is provided for setting the tone volume of the low range speaker 15 alone independently of the master volume 8. Therefore, it is possible to hold the tone volume of the entire speaker system in an optimal balance for acoustic characteristics in the current performance environment by the master volume 8, and further adjust only the tone volume of the low range speaker 15 by the woofer volume 16, thereby obtaining a tone volume balance according to the preference of a player, an environment of a playing site, and so forth.

Figure 8:
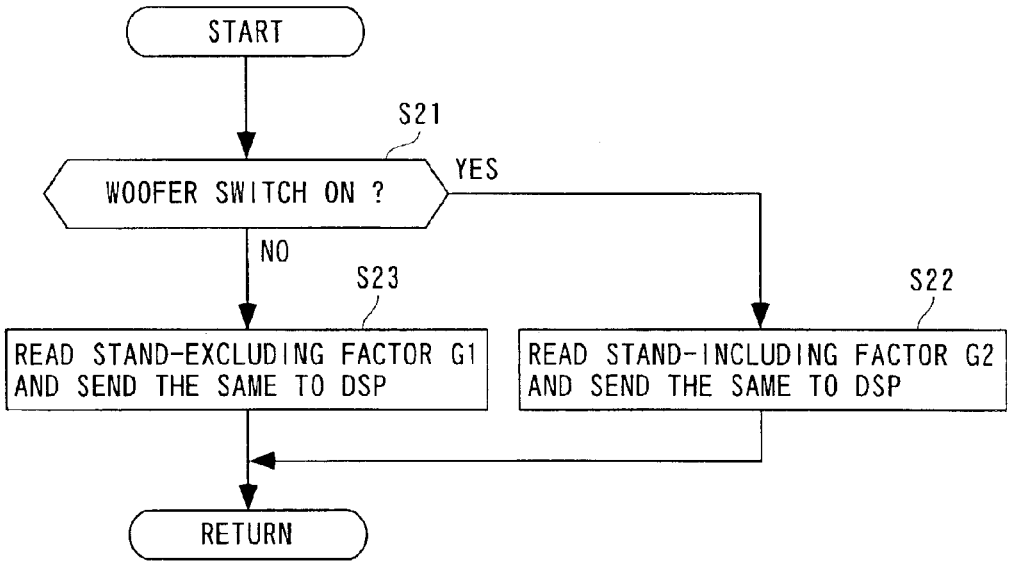
FIG. 8 is a flowchart of a speaker use mode-determining process executed in a second embodiment of the invention.

FIG. 8 shows a routine of a speaker use mode-determining process executed by a second embodiment of the invention. In this process, first, it is determined in a step S21 whether or not the woofer switch 17*a* is ON, i.e. whether or not the jack of the connector cable is plugged into the woofer jack 17. If the answer to the question is affirmative (YES), it is judged that the stand 3 is attached to the piano body 3 for connection between the low range speaker 15 and the piano body 3, and the program proceeds to a step S22, wherein the speaker use mode is set to the both speaker-use mode, and the stand-including factor G2 is read from the frequency characteristic curves. On the other hand, if the answer to the question of the step S21 is negative (NO), it is judged that the stand 3 is not attached to the piano body 3 for connection between the low range speaker 15 and the piano body 3, and the program proceeds to a step S23, wherein the speaker use mode is set to the first speaker-use mode, and the stand-excluding factor G1 is read from the frequency characteristic curves.

As described above, in the present embodiment, it is detected by the woofer switch 17*a* whether or not the stand 3 and the low range speaker 15 are connected to the piano body 3, whereafter the stand-including factor G2 or the stand-excluding factor G1 is read out based on the result of the detection. Therefore, it is possible to automatically set a speaker use mode properly without necessitating any operation by a player, thereby readily obtaining optimal acoustic characteristics depending on whether the low range speaker 15 is integrated or not.

It should be noted that it is possible to combine the method of the first embodiment in which a speaker use mode is designated by the stand-including switch 9*c* or the stand-excluding switch 9*d* and the method of the second embodiment in which a speaker use mode is automatically set, and allow a player to select one of the two methods. For instance, an automatic setting-inhibiting switch may be provided on the operation panel 7 whereby when the automatic setting-inhibiting switch is operated, the automatic setting of a speaker use mode can be inhibited so as to cause designation of a speaker use mode by the stand-including switch 9*c* or the stand-excluding switch 9*d* to be performed with the higher priority. This makes it possible to realize acoustic characteristics reflecting the preference of the player with the higher priority.

Figure 9:
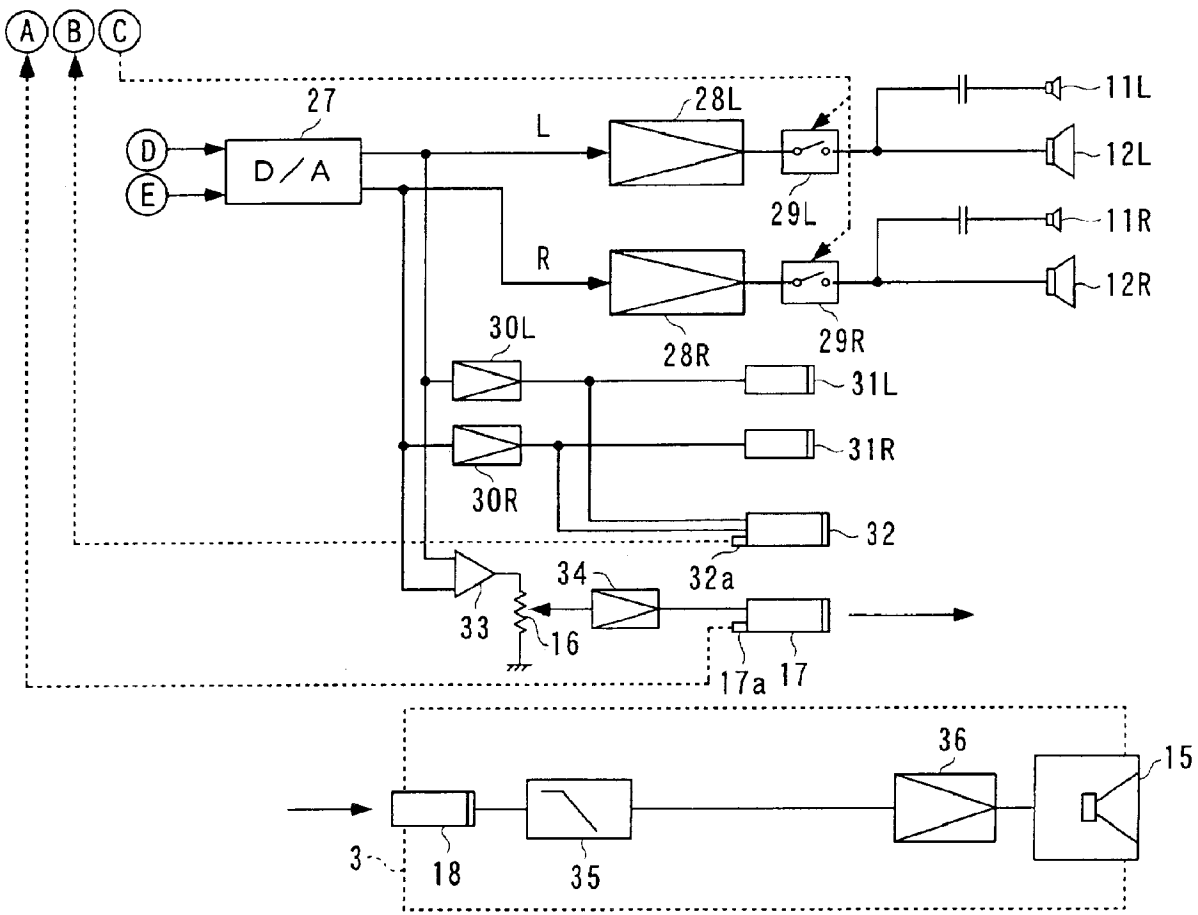
FIG. 9 is a circuit diagram of a variation of the circuitry, corresponding to FIG. 4.

FIG. 9 partially shows a variation of the circuitry of the acoustic control system according to the embodiments of the invention. This variation is distinguished from the above embodiments in which the woofer volume 16 for setting the tone volume of the low range speaker 15 is arranged in the stand 3, in that the woofer volume 16 is arranged in the piano body 2, e.g. on the operation panel 7 of the piano body 2 together with the master volume 8. Therefore, differently from the above embodiments, the variation enables the player to easily operate the two volumes 8, 16 on the operation panel 7, without the inconvenience of reaching out his/her hand to the stand to operate the woofer volume 16.

It should be noted that the present invention is not necessarily limited to the embodiments described above, but can be practiced in various forms. For instance, although in the above embodiments, the low range speaker 15 is arranged in the stand 3 removable from the piano body 2, the low range speaker 15 may be directly attached to the piano body 2 in a removable manner. Further, although the woofer switch 17*a* for detecting connection between the woofer jack 17 and the jack of the connector cable is used as detection means for detecting whether the stand 3 is attached or not, this is not limitative, but means for detecting the presence or absence of the screws connecting between the piano body 2 and the stand 3 may be employed, for example. Moreover, although in the above embodiments, the present invention is applied to the electronic piano, this is not limitative, but it is possible to apply the invention to other suitable electronic instruments, including an electronic organ.

It is further understood by those skilled in the art that the foregoing is a preferred embodiment of the invention, and that various changes and modifications may be made without departing from the spirit and scope thereof.

What is claimed is:

1. An acoustic control system for an electronic musical instrument, comprising:

a musical instrument body having a first speaker;

a second speaker removable from said musical instrument body;

designation means for designating one of a first speaker-use mode for using said first speaker alone and a both speaker-use mode for using both said first speaker and said second speaker, as a speaker use mode;

storage means for storing first and second acoustic-characterizing factors different from each other, for use in setting acoustic characteristics in the first speaker-use mode and the both speaker-use mode, respectively;

reading means for reading one of the first and second acoustic-characterizing factors, the one corresponding to the speaker use mode designated by said designation means; and musical tone signal-generating means for generating a musical tone signal to be reproduced through said first speaker or both said first speaker and said second speaker, based on the read one of the first and second acoustic-characterizing factors.

2. An acoustic control system according to claim 1, wherein said designation means comprises a switch for operation by a player for designation of the speaker use mode.

3. An acoustic control system according to claim 1, wherein said designation means includes detection means for detecting whether or not said second speaker is attached to said musical instrument body, and setting means for setting the speaker use mode to the first speaker-use mode when it is detected by said detection means that said second speaker is not attached to said musical instrument body, and setting the speaker use mode to the both speaker-use mode when it is detected by said detection means that said second speaker is attached to said musical instrument body.

4. An acoustic control system according to claim 1, wherein said second speaker is a speaker for reproducing tones in a low-frequency range.

5. An acoustic control system according to claim 1, further including tone volume-setting means for setting a tone volume of said second speaker independently of a tone volume of the first speaker.

6. An acoustic control system according to claim 1, wherein said second speaker is arranged in a stand that is removably attached to said musical instrument body, for supporting said musical instrument body.

* * * * *